United States Patent [19]

Otters

[11] Patent Number: 4,774,808

[45] Date of Patent: Oct. 4, 1988

[54] DISPLACER ARRANGEMENT FOR EXTERNAL COMBUSTION ENGINES

[76] Inventor: John L. Otters, 11317 Miller Rd., Whittier, Calif. 90604

[21] Appl. No.: 70,080

[22] Filed: Jul. 6, 1987

[51] Int. Cl.[4] ..... F02G 1/04

[52] U.S. Cl. ..... 60/526; 60/517; 60/522

[58] Field of Search ..... 60/517, 526, 522

[56] References Cited

U.S. PATENT DOCUMENTS 3,688,512 9/1972 Prast et al. ..... 60/526

3,717,004 2/1973 O'Neil ..... 60/517 X 4,488,402 12/1984 Sieck ..... 60/517

*Primary Examiner*—Allen M. Ostrager

*Attorney, Agent, or Firm*—Natan Epstein; William H. Pavitt, Jr.

[57] ABSTRACT

An external combustion engine is provided with an engine body containing a cylinder, a working fluid within the cylinder, and a displacer piston reciprocable between two ends of the cylinder. A heat exchanger matrix permeable to said working fluid is provided at one end of the cylinder. The movement of the displacer establishes a flow path through a limited portion of the matrix such that the working fluid exchanges heat with different portions of the matrix at different displacer positions as the fluid is displaced between the two ends of the cylinder.

26 Claims, 4 Drawing Sheets

DISPLACER ARRANGEMENT FOR EXTERNAL COMBUSTION ENGINES

BACKGROUND OF THE INVENTION

1. Field of the Invention

The present invention pertains generally to the field of external combustion engines such as Stirling cycle engines and is more particularly directed to a regenerative displacer and associated heat exchanger arrangement for subjecting the working fluid in such an engine to a thermodynamic cycle from which is derived a work output.

2. State of the Prior Art

In an external combustion closed cycle engine a sealed working fluid, usually a gas, is alternately displaced between a hot end and a cold end of a displacer cavity by a reciprocating displacer body such that it undergoes successive volumetric expansion and contraction cycles which drive a work piston or otherwise produce a work output.

Many different schemes have been devised for transferring heat to the working fluid during one portion of the displacer stroke and extracting heat from the fluid during another portion of the displacer stroke. Most commonly, the working fluid is passed through a heat exchanger conduit where heat is transferred by conduction between the working fluid and a heat exchanger medium. It is also conventional to provide a regenerator device in the fluid flow path between the hot and cold ends for storing heat as the working fluid passes through the cooling portion of the thermodynamic cycle.

In a conventional heat exchanger all of the working fluid displaced during each stroke of the displacer passes through a single heat exchanger conduit which must be relatively long in order to absorb sufficient heat from all the displaced fluid. As the flow of working fluid through the heat exchanger must necessarily be restricted in order to maintain good heat exchanging contact with the operative surfaces of the heat exchanger, a relatively large drop in working fluid pressure occurs across the heat exchanger. This pressure drop is particularly significant at the cold end of the displacer cavity where gas density is greatest and significantly reduces the overall efficiency of the engine. Various attempts have been made to minimize this pressure drop, such as the design illustrated in "Principles and Applications of Stirling Engines" Colin West, 1986, page 212. In this arrangement, a permeable heater is mounted on the displacer and is heated by conduction through a thin gas layer by a hot head at one end of the displacer bore. As the displacer moves from the cold end to the hot end, the working fluid passes through the porous heater and a regenerator also on the displacer, and is cooled by contact with a liquid cooled working piston. This engine, however, makes use of a very short displacer stroke and relies on large surface areas for heat transfer, in spite of which the work output achieved is minimal in relation to the engine's physical size and weight.

A continuing need exists for improved, more efficient displacer arrangements for Stirling cycle and similar engines.

BRIEF SUMMARY OF THE INVENTION

This invention advances the state of the art by providing a simple but efficient displacer arrangement for an external combustion engine of the type having an engine body, a displacer cavity in the engine body charged with a working fluid and a displacer reciprocable through a stroke between two ends of this cavity.

The improved low pressure drop heat exchanger includes a stationary heat exchanger matrix permeable to the working fluid and associated with one end of the displacer cavity. Working fluid is displaced between the two cavity ends responsive to reciprocating movement of the displacer through a flow path passing through the displacer. This flow path includes an instantaneous flow path through a limited portion of the stationary matrix. The instantaneous flow path is defined by seal elements and port openings on the displacer which place the matrix in fluidic communication with the opposite end of the displacer cavity. The instantaneous flow path follows the reciprocating movement of the displacer and is swept back and forth through the stationary matrix so that the working fluid exchanges heat with different portions of the matrix at different displacer positions along its stroke.

The stationary matrix can be a tube of porous heat conductive material cooled by any suitable means such as a coil carrying a collant fluid through the matrix. The matrix tube is arranged coaxially with and open to the cold space of the displacer cavity so that working fluid may pass between the cavity and the matrix interior substantially along the entire length of the matrix tube. The displacer has one end closed to the matrix side of the displacer cavity and another opposite displacer end open to the hot space of the displacer cavity. One or more ports on the displacer admit fluid flow between the matrix and the open end of the displacer, thus placing the matrix in fluidic communication through the displacer with the hot space of the displacer cavity. A lower dynamic seal is arranged radially between the displacer and the matrix and axially between the displacer ports and the closed displacer end, and an upper dynamic seal is likewise radially arranged but is axially between the ports and the open displacer end. The displacer reciprocates through the matrix such that at least the displacer ports and the lower seal are within the matrix tube at all points of the displacer stroke, while the open end of the displacer is open to the hot space but closed to the matrix. Working fluid displaced by the reciprocating displacer between the hot and cold spaces flows through the matrix. The working fluid tends to follow the path of least resistance through the matrix and therefore will tend to enter or leave the matrix tube in the immediate vicinity of the closed displacer end. The net result is that an instantaneous flow path is created through that axial segment of the matrix which at any given position of the displacer substantially lies between the displacer ports and the closed displacer end. The fluid flow path through the matrix therefore moves continuously together with the displacer, directing working fluid through axially consecutive sections of the matrix in step with the displacer movement. The instantaneous fluid flow path through the matrix remains relatively short and substantially fixed in length as measured between the displacer ports and the cold side of the displacer cavity for all positions of the displacer. As a result, the net length of the flow path through the heat exchanger for each portion of displaced fluid can be made relatively short without diminishing total heat transfer over the entire displacer stroke. As this instantaneous fluid flow path tracks the displacer through the cold matrix, heat from the working fluid is distributed through a relatively large matrix body. The shorter flow path results in a reduced drop in fluid pressure across the heat exchanger matrix and therefore improves the efficiency of the engine.

The novel system is approximately equivalent to several heat exchangers connected in parallel with displaced fluid being directed sequentially through each heat exchanger in turn during different portions of each stroke of the displacer. The total flow path length through each of the parallel heat exchangers is considerably less than would be required of a single heat exchanger of equivalent capacity.

This heat exchanger matrix arrangement is most beneficial at the cold end of the displacer cavity because of the greater gas density and viscosity there. The arrangement disclosed herein may be however reversed and adapted to operation at the hot end of the displacer cavity.

The heat exchanger matrix arrangement of this invention is particularly suited for use with a displacer mounted regenerator element within the fluid flow path between the displacer ports and the open hot end of the displacer. The regenerator is constructed in accordance with known principles to minimize heat losses in an axial direction and insulated about its radial periphery to minimize shuttle losses in the so-called "appendix gap" annulus between the displacer body and the cylinder bore.

Still further, a heat exchanger may be mounted at the hot end of the displacer and supplied with heat primarily by radiation from a radiant heater element at the hot end of the displacer cavity, such that working fluid passes through both the heat exchanger and the regenerator. The displacer mounted regenerator and heat exchanger may be insulated from each other with fluid permeable insulation.

Radiant heat transfer to the displacer mounted heat exchanger may be improved by coating the radiant surface with a thin layer of emissivity enhancing material specified below and characterized by an emissivity coefficient which increases with the temperature of the material. Such coating is particularly advantageous where the radiant heater is made of silicon carbide or similar high temperature ceramic having good thermal conductivity but an emissivity coefficient varying inversely with its temperature. The emissivity enhancing coating may also be applied to the insulation between the regenerator and displacer mounted heat exchanger to re-radiate heat back towards the heat exchanger and minimize thermal losses through the regenerator.

These and other advantages of the present invention will be better understood from the following detailed description taken with reference to the accompanying drawings.

DETAILED DESCRIPTION OF THE PREFERRED EMBODIMENTS

Figure 1:
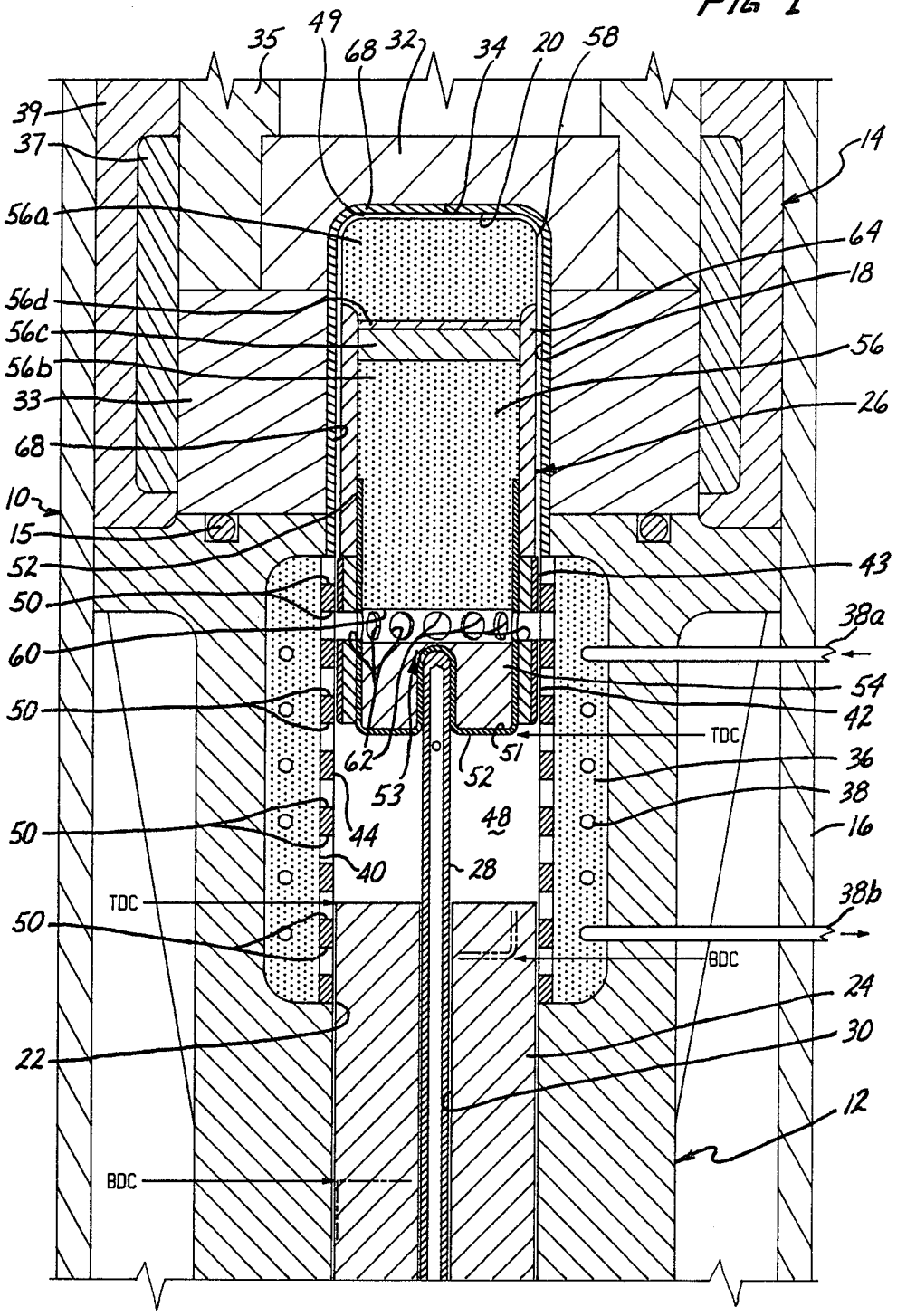
FIG. 1 is a partial longitudinal section of a typical Stirling cycle engine illustrating the improved displacer arrangement and showing the displacer in top dead center position within the displacer cavity.

FIG. 1 shows a longitudinal segment of a Stirling cycle engine body 10 which includes a body section 12 and a hot head assembly 14 held in axially assembled relationship by an outer tubular shell 16 acting compressively on the ends (not shown) of the heater head 14 and body section 12. The joint between the heater head and engine body is sealed by a static ring seal 15. The heater head assembly 14 and body section 12 together define a cylindrical displacer cavity or bore 18 which is closed at a hot end 20 and is sealed at an opposite cold end 22 by a reciprocable work piston 24. The displacer cavity 18 is charged with a pressurized working gas such as hydrogen which is subjected to alternate heating and cooling cycles upon being displaced between a hot space 49 and a cold space 48 by a reciprocable displacer 26. The displacer 26 is fixed to the end of a guide rod 28 slidable within an axial bore 30 in the work piston and thus stably supported in centered relationship within the displacer bore 18. The displacer 26 is reciprocated between the hot end 20 and cold end 22 by a suitable displacer drive system (not shown) selected from among various drive systems known in the art.

The heater head assembly 14 includes a radiant heater element 32 having a radiant surface 34 which closes the bore 18 at the hot end. The heater element is heated by any suitable heat source (not shown) such as a gas burner or a flow of hot fluid such as molten sodium circulating through suitable heat exchanger conduits. The heater element 32 is thermally insulated from the engine body 12 and outer shell 16 by insulation rings 33 and 35. Both of these rings are encompassed and held in radial compression by ring 37 and further insulated by outer ring 39.

A tubular matrix 36 coaxially surrounds the cold space 48 of the displacer cavity and extends longitudinally from the cold end 22 to an intermediate point of the displacer bore. The matrix is of heat conductive material and may, for example, consist of copper pellets or particles sintered together to form a porous unitary tubular mass permeable to fluid flow both radially and axially. The matrix 36 is cooled by any appropriate means such as coolant fluid circulating through a coiled conduit 38 embedded in the matrix and having a coolant inlet **38*a* and coolant outlet 38*b***.

The matrix 36 has a cylindrical inner surface 40 separated from the displacer bore by a bearing tube 44 perforated by numerous holes 50 along its length such that the matrix is open to the cold space 48 substantially along its entire length. The bearing tube 44 is coaxially interposed between the matrix surface 40 and the displacer 26 and provides a smooth cylinder wall for the displacer.

The displacer 26 includes a cup 52 with a closed bottom 51 filled by a block 54 of inert filler material and fixed to the upper end of guide rod 28. The open upper end of the cup 52 carries a generally cylindrical assembly 56 of fluid permeable materials comprising a regenerator **56*b*, a heat shield 56*c* to which is applied a thermal emmissivity enhancing coating 56*d* and a heat exchanger 56*a* which has an upper end surface 58 facing the radiant heater surface 34. The lower end 60 of the permeable assembly 56 is spaced from the filler block 54 to define a chamber 53 in the displacer. A circumferential row of radial ports 62 is defined in the cylindrical wall of the displacer cup 52 which open the chamber 53 to fluidic communication with the matrix through whichever bearing sleeve holes 50 happen to be aligned with ports 62** at any given instant during the displacer stroke.

The displacer 26 carries an upper annular seal bearing and back-up ring assembly 43 and cylindrical insulation sleeve 64 which substantially prevent fluid flow into or out of the matrix 36 at points above the radial ports 62 for all positions of the displacer. The sleeve 64 encompasses the lower and intermediate portions of the permeable assembly 56 to confine gas flow through the regenerator **56*b* and heat shield 56*c* between the displacer chamber 53 and the heat exchanger 56*a*. The insulating sleeve 64 also reduces shuttle heat losses through the annular gap between the displacer body and cylinder bore 18. The displacer 26 also carries a lower annular seal beating and back up ring assembly 42 arranged radially between the displacer and the bearing sleeve 44 and longitudinally between the ports 62 and closed cup bottom 51. The dynamic seals 42 and 43 on the displacer cooperate with the bearing tube 44 and divide the displacer bore 18 into an upper hot space 49 and a lower cold space 48**.

A fluid flow path is therefore defined between the hot space 49 and cold space 48 of the displacer cavity which beginning from the hot space 49 of the bore 18 passes through the displacer mounted permeable assembly 56 and chamber 53, then through radial ports 62 and aligned apertures 50 in the bearing sleeve 44 into the matrix 36 from which the gas is free to enter the cold space 48 of the displacer bore through all bearing sleeve openings 50 which lie below the lower dynamic seal 42 at any given instant in the stroke of the displacer 26.

Figure 2:
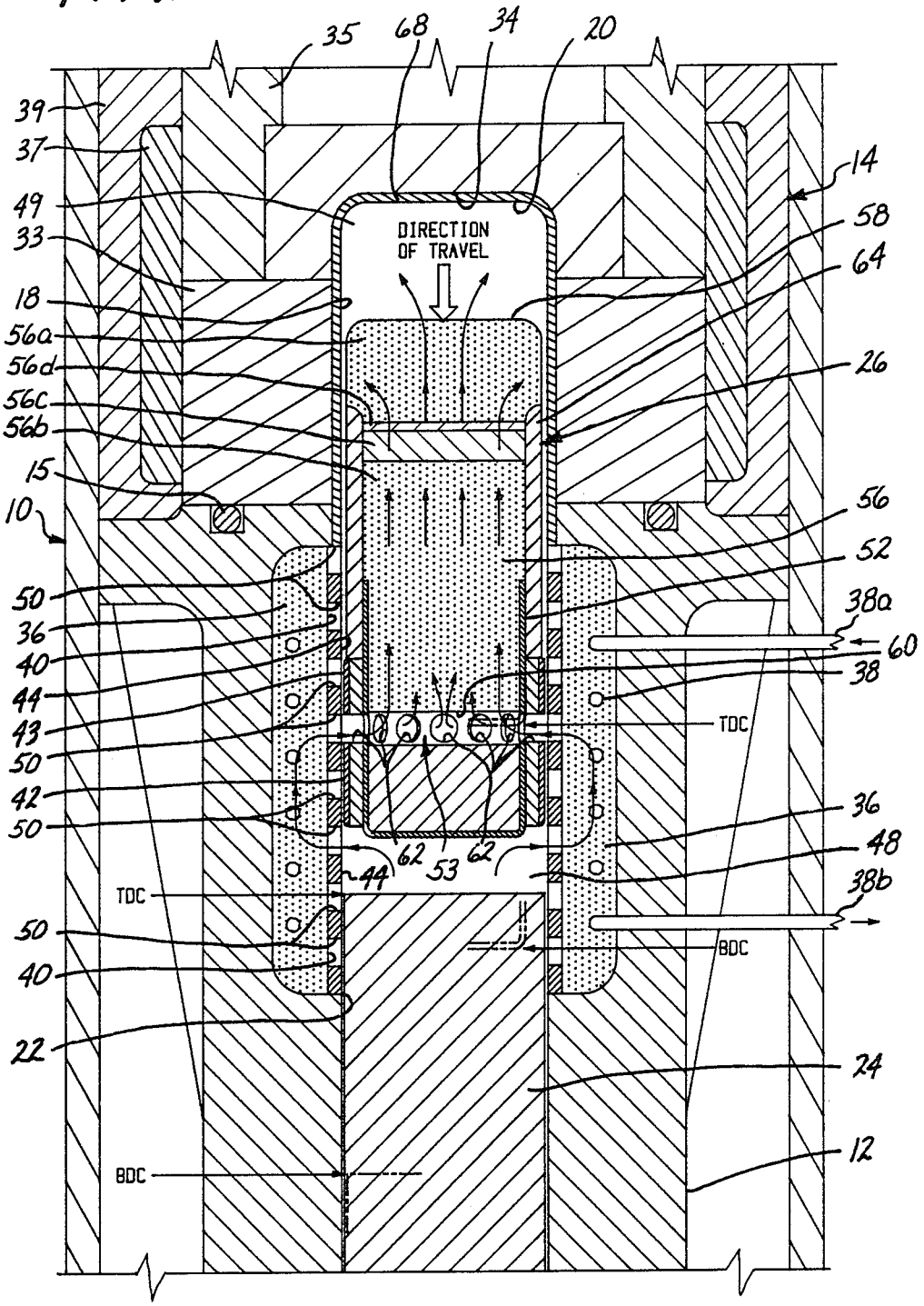
FIG. 2 is a view as in FIG. 1 with arrows indicating the flow path of working fluid displaced during displacer down stroke, the displacer being shown without a guide rod.
Figure 3:
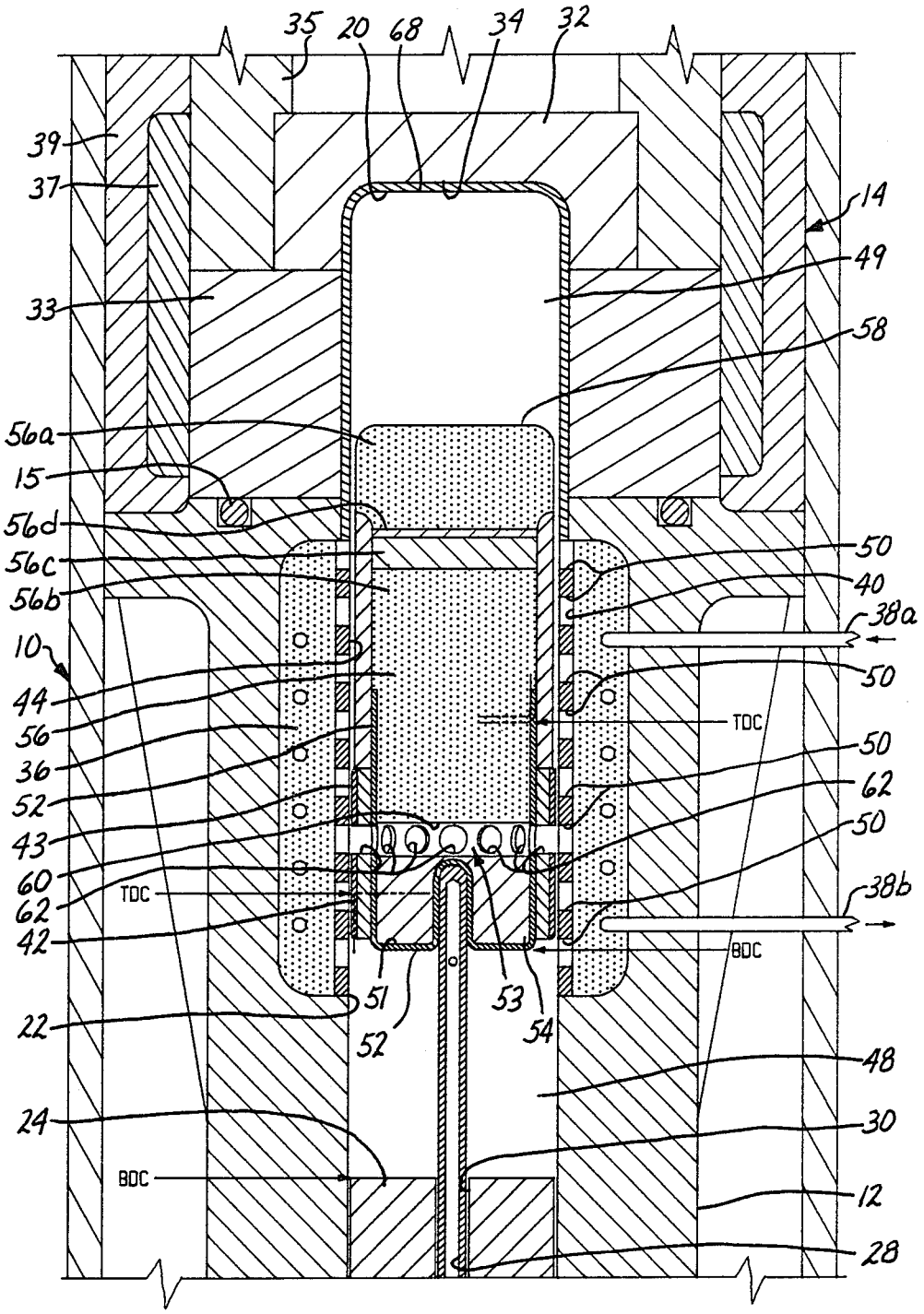
FIG. 3 is a view as in FIG. 1 but showing the displacer in bottom dead center position.

Turning now to FIG. 2, the displacer 26 is shown moving downwardly within the bore 18 from the top dead center position of FIG. 1 towards the bottom dead center position shown in FIG. 3. As the displacer moves downwardly from the hot end 20 towards the cold end 22, working gas is displaced from the cold space 48 and forced into the porous cooling matrix 36, from which the only outlet is the path offered by the ports 62 in alignment with a particular set of holes 50 in the bearing tube 44. The gas therefore flows from the matrix 36 into the displacer chamber 53 and then upwardly through the permeable assembly 56 from where it is discharged at the upper end 58 into the hot space 49 of the displacer bore 18.

The fluid displaced from the cold space 48 will tend to follow the path of least resistance indicated by the arrows in FIG. 2 through the matrix 36 and into the displacer chamber 53. This path is obtained by entry into the matrix through the holes 50 below but nearest to the seal 42 and then exiting from the matrix 36 through the holes 50 in current alignment with the displacer ports 62. This flow path minimizes the distance through the matrix traversed by the gas.

As the displacer 26 moves downwardly through the matrix tube 36 the flow path through the matrix illustrated by the arrows sweeps along the matrix keeping pace with the displacer. In other words, the gas influx to the matrix from the cold space 48 will tend to move from one group of holes 50 to the next group of holes 50 as the displacer progresses downwardly because the path of least resistance will always be through the holes 50 nearest to the closed bottom of the displacer. At the same time, flow from the matrix 36 into the displacer will always occur through whichever holes 50 are aligned with the radial ports 62 at any given instant in the displacer stroke. The net result is that the length of the gas flow path from the cold space 48 through the cold matrix 36 and into the permeable assembly 56 remains constant throughout the displacer stroke, but this gas flow path moves through successive sections of the matrix tube following the position of the displacer along the axis of the matrix tube.

Turn now to FIG. 3 where the work piston 24 initially in top dead center position in FIGS. 1 and 2, is shown driven to bottom dead center position by expansion of the working gas at the hot end. The displacer has now reached bottom dead center and from this position the displacer is returned by any suitable displacer drive system towards top dead center. As the displacer 26 moves upwardly in the bore 18 in FIG. 4, working gas is now displaced from the hot space 49 through the permeable assembly 56, chamber 53, ports 52 and aligned holes 50 into the cold matrix 36 where the working gas is cooled, and finally into the cold space 48 of the displacer bore. As before, the gas will tend to follow the path of least resistance through the matrix which is again offered by the holes 50 nearest to the bottom side of the displacer seal 42. The flow path is thus the same as on the up stroke of the displacer described in connection with FIG. 2, except the direction of flow is now reversed. The overall length of the instantaneous flow path through the matrix 32 is also the same and substantially as shown by the arrows in FIG. 4. This instantaneous flow path moves upwardly and sweeps along the matrix tube together with the displacer.

From the foregoing it will be clear that as the displacer 26 moves longitudinally through the matrix tube in either direction the displaced working gas is circulated through sequentially adjacent axial sections of the matrix previously unexposed to hot working gas during each particular stroke of the displacer, and consequently able to quickly absorb substantial amounts of heat from the working gas over a relatively short instantaneous flow path through the matrix.

The permeable displacer assembly 56 preferably comprises a heater **56*a*, a porous heat shield 56*c* with a thin re-radiating type of ceramic coating 56*d* bonded to the upper face of the porous shield, and a regenerator 56*b*. The heater 56*a* may be formed of a block of porous graphite which is a good heat conductor and absorber of radiant energy at high temperatures. The porous body 56*a* functions as a heat exchanger by absorbing radiant heat from the hot head 32 and transferring the heat into the gas by conduction and convection as the gas flows through the displacer in either direction. The heat shield 56*c* may be of zirconia fiber felt insulation material, a good heat insulator which helps to reduce heat conduction losses between the heater element 56*a* and the regenerator 56*b*. The zirconia felt material is commercially available in porosity ranges of 50% to 70% for relatively low restriction to gas passage through the displacer. An emissivity enhancing ceramic coating 56*d* can be applied on the upper side of the porous heat shield 56*c* to re-radiate heat energy back into the heater 56*a*, thereby reducing radiant heat losses from the heater 56*a* into the regenerator 56*b*. The ceramic coating 56*d* is readily available commercially and subsequently will be described in more detail. The regenerator 56b** can be fabricated from materials well known in the art, i.e. from fine wire copper and/or stainless steel screens.

In the alternative, the displacer assembly 56 could also be constructed as a single, unitary body of permeable honeycomb material which would combine the functions of heater element 56a and the regenerator 56b into a single operative matrix unit. For example, a preferred honeycomb material has a thin-finned, extruded isosceles triangular matrix surface as described in Transactions of the ASME, Journal of Engineering for Power, October, 1977, page 643. The referenced page is part of an article entitled, "The Effect of Fin Geometry and Manufacturing Process on Ceramic Regenerator Thermodynamic Performance", by C. A. Fucinari, Research Staff, Ford Motor Co., Dearborn, Michigan. The indicated honeycomb triangular matrix structure is available commercially in a lithium aluminum silicate material, Corning No. 5KC552XL, from Corning Glass Works, Ceramic Products Division, Automotive Products Department, Corning, New York 14830. The material is further described in Transactions of the ASME, Journal of Engineering for Power, Paper No. 77-GT-60, March, 1977, entitled "Aluminous Keatite--An Improved Rotary Ceramic Regenerator Core Material", by D. G. Grossman and J. G. Lanning. A flat radiation heat shield, (not shown in the drawings) to reflect heat back towards the hot end of the displacer chamber 53, could be applied to the upper face of the displacer filler block 54.

Heat radiated from the hot head 32 into the upper face of the displacer matrix 56 is efficiently absorbed whether this face is of porous material such as graphite or of a manufactured honeycomb structure because each pore or hoenycomb cell acts as a cavity radiator and absorbs a greater amount of heat than a surface equal to the pore or cell opening, thereby producing a radiation enhancement cavity effect.

When the displacer moves from the cold end to the hot end, the working gas flowing through the honeycomb matrix will absorb heat from the thin (0.005 inch) matrix fins, so that the upper portion of the matrix functions as an effective heat exchanger. As the heated working gas continues to flow downwardly through the honeycomb matrix, heat will be transferred from the hot gas into the progressively cooler thin matrix fins. Also, because of the thin honeycomb fin structure, conductive heat losses through the fin material from the hot to the cold end of the displacer will be relatively low. When the displacer moves from the hot end to the cold end, the opposite process occurs where the working gas flowing through the matrix 56 progressively absorbs heat from the thin fin walls of the honeycomb structure and leaves the upper heated end 58 at a high temperature. Therefore, a single permeable matrix body 56 may function as a combined heat exchanger and regenerator.

The inner radiant surface 34 of the heater head 32 is desirably coated with an emissivity enhancing material. Specifically, a coating 68 as shown in FIGS. 1 through 3, of a proprietary ceramic refractory product commercially available from Ceramic-Refractory Corporation, Rutledge Road, Transfer, Pennsylvania, 16154, is applied as shown in the drawings to the radiating surface of the heater head and extending along the inner wall surface of the displacer bore in the hot space 49. This ceramic refractory coating is available in various formulations characterized by an emissivity coefficient which increases with temperature. According to the manufacturer, these coatings have an emissivity rating of 0.90 at 1600 degrees Fahrenheit, 0.94 at 2000 degrees Fahrenheit, and at 3000 degrees Fahrenheit the emissivity value closely approaches black body radiation characteristics. The heater element 32 may be formed of silicon carbide ceramic which is a very good heat conductor but suffers from an emissivity value which tends to fall off at high temperatures, particularly at the high operating temperatures desired for Stirling engines of this type. At temperatures above 1500 degrees Fahrenheit, metal components are no longer practical and it therefore becomes necessary to resort to alternate materials for construction of the engine heater head assembly. While some ceramics easily withstand temperatures in the three to four thousand degree Fahrenheit range and higher, virtually all ceramics exhibit the characteristic of diminishing emissivity with increasing temperature. This problem is overcome according to this invention by providing the aforementioned emissivity enhancing coating 68 on the radiating surface 34 of the heater element 32. In this manner, the good heat conductivity of the ceramic block 32 is used to advantage for delivering heat to the radiant surface 34 from which it is radiated with the assistance of the coating 68 onto the displacer surface 58. The specified ceramic refractory coating is waterbased and easily applied to the radiant surface 34, and when dry forms a very thin layer 68.

Figure 4:
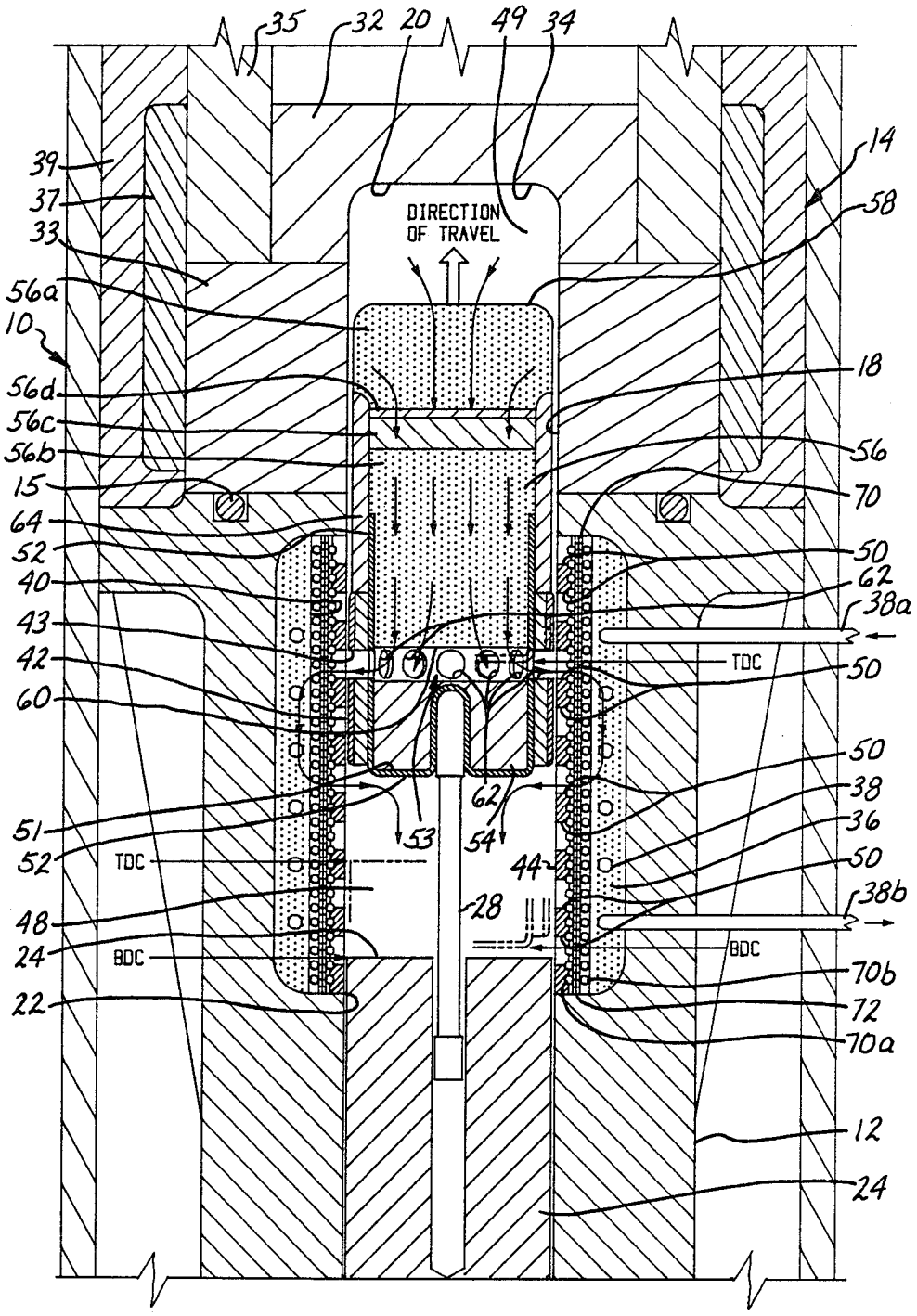
FIG. 4 is a view as in FIGS. 1–3 with arrows indicating the flow of working fluid during displacer upstroke and further showing a preferred arrangement of electromagnetic displacer drive coils.

FIG. 4 shows a preferred arrangement for an electromagnetic displacer drive coil assembly 70 arranged coaxially with the displacer bore intermediate the matrix 36 and the bearing sleeve 44. Also shown is an upper bearing seal ring assembly 43 which separates the side of chamber 53 from the hot space 49. In the illustrated example, the drive coil assembly 70 consists of two cylindrical coil winding layers 70a and 70b separated by an intermediate layer 72 of electrically nonconducting open mesh material. The individual turns of each winding layer 70a and 70b are slightly separated in an axial direction so as to allow substantially free flow of the working gas through the winding layers and the intermediate mesh layer 72, maintaining an unobstructed flow path through the drive coil between the matrix 36 and displacer chamber 18.

Particular embodiments of the present invention have been shown and illustrated for purposes of clarity and example only. Many changes, substitutions and modifications to the described embodiments will be readily apparent to those possessed of ordinary skill in the art without thereby departing from the spirit and scope of the present invention which is defined only by the following claims.

What is claimed is:

1. In an external combustion engine of the type having an engine body, a displacer cavity in said body, a working fluid in said cavity and a displacer reciprocable through a stroke between two ends of said cavity, the improvement comprising:

a heat exchanger matrix permeable to said fluid and associated with one end of said displacer cavity; and means defining a flow path including an instantaneous flow path through a limited portion of said matrix through which flow path said fluid is displaced between said ends responsive to reciprocating movement of said displacer;

said instantaneous flow path being swept through said matrix with movement of said displacer so that said working fluid exchanges heat with different portions of the matrix at different displacer positions along said stroke.

2. The improvement of claim 1 wherein said displacer is closed to one end of said cavity and open to the opposite end of said cavity, said matrix is open to said one cavity end, and said flow path includes port means on said displacer open to fluid flow between a limited portion of said matrix and said opposite cavity end, said port means opening to different portions of the matrix at different positions of the displacer.

3. The improvement of claim 1 wherein said flow path includes regenerator means on said displacer.

4. The improvement of claim 2 wherein said flow path further includes regenerator means on said displacer between said port means and said open displacer end.

5. The improvement of claim 2 wherein said means defining said flow path comprise seal means radially between said displacer and said matrix.

6. The improvement of claim 5 wherein said seal means are axially between said closed displacer end and said port means.

7. The improvement of claim 6 further including second seal means radially between said displacer and said matrix and axially between said port means and said open end of the displacer.

8. The improvement of claim 2 further comprising heat exchanger means on said displacer in said flow path for heating working fluid passing through said displacer and heater means for supplying heat to said heat exchanger means.

9. The improvement of claim 8 wherein said heater means comprises radiant heater means arranged at one end of said cavity opposite said matrix.

10. The improvement of claim 9 further comprising heat insulating means open to fluid flow between said heat exchanger means and said regenerator means on said displacer.

11. In an external combustion engine of the type having an engine body, a displacer cavity in said body, a working fluid in said cavity and a displacer reciprocable through a stroke between two ends of said cavity, the improvement comprising:

a heat exchanger matrix permeable to said fluid and associated with one end of said displacer cavity; and means including seal means radially between said displacer and said matrix defining a flow path including an instantaneous flow path through a limited portion of said matrix through which flow path said fluid is displaced between said ends responsive to reciprocating movement of said displacer;

said instantaneous flow path being swept through said matrix with movement of said displacer so that said working fluid exchanges heat with different portions of the matrix at different displacer positions along said stroke;

heat exchanger means on said displacer in said flow path and radiant heater means arranged at one end of said cavity opposite said matrix for supplying heat to said heat exchanger means for heating working fluid passing through said displacer; and regenerator means on said displacer in said flow path between said heat exchanger matrix and said heat exchanger means.

12. In an external combustion engine of the type having an engine body, a displacer cavity in said body, a working fluid in said cavity and a displacer reciprocable through a stroke between two ends of said cavity, the improvement comprising:

a heat exchanger matrix permeable to said fluid and open to one end of said displacer cavity;

one end of said displacer being closed to said one end of said cavity and the other end of said displacer being open to the opposite end of said cavity, and port means in said displacer communicating a portion of said matrix with said opposite cavity end for defining a flow path including an instantaneous flow path through a limited portion of said matrix lying between said closed displacer end and said port means through which said fluid is displaced between said ends responsive to reciprocating movement of said displacer;

said instantaneous flow path being swept through said matrix with movement of said displacer so that said working fluid exchanges heat with different portions of the matrix at different displacer positions along said stroke.

13. The improvement of claim 12 further comprising regenerator means on said displacer in said flow path between said port means and said open displacer end.

14. In an external combustion engine of the type having an engine body, a displacer cavity in said body, a working fluid in said cavity and a displacer reciprocable through a stroke between two ends of said cavity, the improvement comprising:

a heat exchanger matrix permeable to said fluid and open to one end of said displacer cavity;

one end of said displacer being closed to said one end of said cavity and the other end of said displacer being open to the opposite end of said cavity;

port means in said displacer comunicating a portion of said matrix with said opposite cavity end;

seal means between said displacer and said matrix and between said port means and said closed displacer end for diverting fluid flow between said port means and said one end of said cavity through a limited portion of said matrix lying between said closed displacer end and said port means;

regenerator means on said displacer between said port means and said open displacer end;

said seal means, port means and regenerator means together defining a flow path including an instantaneous flow path through said limited portion of said matrix through which said fluid is displaced between said cavity ends responsive to reciprocating movement of said displacer;

said instantaneous flow path being swept through said matrix with movement of said displacer so that said working fluid exchanges heat with different portions of the matrix at different displacer positions along said stroke.

15. The improvement of claim 14 further comprising heat exchanger means on said displacer at said open end thereof in said flow path for heating working fluid flowing through said displacer, and radiant heater means at said hot end for radiantly supplying heat to said displacer mounted heat exchanger means.

16. The improvement of claim 15 further comprising heat insulating fluid permeable means in said flow path between said heat exchanger means and said regenerator means.

17. The improvement of claim 16 further comprising emissivity enhancing means coating said heat insulating means for re-radiating heat towards said heat exchanger means.

18. A regenerative displacer for a closed-cycle external combustion engine of the type having an engine body, a displacer cavity in said body, a working fluid in said cavity and a displacer reciprocable through a stroke between a hot end and a cold end of said cavity, the improvement comprising:

regenerator means on said displacer;

a cooling matrix open to the cold end of said cavity; and first means associated with said displacer defining a fluid flow path between said hot end and said cold end through said cooling matrix and said regenerator means, said first means directing fluid flow between said regenerator and said cooling matrix through successive portions of said matrix as said displacer moves between said hot and cold ends thereby to maintain a relatively short flow path with a low pressure-drop between said regenerator and said cold end.

19. The improvement of claim 18 wherein said cooling matrix has an inner surface open to the cold end of said cavity, said first means including port means on said displacer of restricted aperture in relation to said open inner surface for diverting fluid flow between the displacer and cooling through a relatively small longitudinal section of said matrix at any given point along the displacer stroke.

20. The improvement of claim 19 wherein an apertured bearing sleeve is interposed between said matrix inner surface and said displacer cavity.

21. A regenerative displacer for a closed-cycle external combustion engine of the type having an engine body, a displacer cavity having a tubular cavity wall in said body, a working fluid in said cavity and a displacer reciprocable through a stroke axis between a hot space and a cold space in said cavity, the improvement comprising:

regenerator means on said displacer open to said hot space;

a tubular fluid permeable cooling matrix open to said cold space;

radial port means on said displacer for admitting fluid flow between said regenerator and said matrix thereby fluidically communicating said hot and cold spaces; and seal means between said displacer and said matrix for diverting flow of displaced fluid through an axially limited section of said matrix tube;

said port means reciprocating axially relative to said matrix whereby fluid flow between said regenerator and said cold space is directed through axially successive portions of said cooling matrix during reciprocal movement of said displacer.

22. The improvement of claim 21 wherein an apertured bearing sleeve is interposed between said matrix and said displacer.

23. The improvement of claim 21 further comprising radiant heater means at said hot end for heating a heat exchanger provided on said displacer, said regenerator being intermediate said heat exchanger and said port means in the working fluid path.

24. The improvement of claim 23 wherein said heat exchanger and said regenerator means consist of a single fluid permeable body on said displacer having a radiation absorbing hot end exposed to said radiant heater means and a cooler end open to said port means.

25. The improvement of claim 24 wherein said radiant heater means include a heater head having a heat radiating surface and emissivity enhancing means on said radiating surface for improved radiant heat transfer to said hot sink.

26. The improvement of claim 25 wherein said emissivity enhancing means comprise a thin coating of ceramic material characterized by an emissivity coefficient which increases in proportion to temperature.

* * * * *